United States Patent [19]

Muto

[11] Patent Number: 4,470,382

[45] Date of Patent: Sep. 11, 1984

[54] VALVE LASH ADJUSTER FOR AN INTERNAL COMBUSTION ENGINE

[75] Inventor: Naoto Muto, Hachioji, Japan

[73] Assignee: Fuji Jukogyo Kabushiki Kaisha, Tokyo, Japan

[21] Appl. No.: 390,155

[22] Filed: Jun. 21, 1982

[30] Foreign Application Priority Data

Jun. 26, 1981 [JP] Japan ..... 56-100329

[51] Int. Cl.[3] ..... F01L 1/24

[52] U.S. Cl. ..... 123/90.59; 123/195 HC

[58] Field of Search ..... 123/90.45, 90.55, 90.46, 123/195 HC, 51 A, 90.57, 90.59

[56] References Cited

U.S. PATENT DOCUMENTS

| | | | |
|---|---|---|---|
| 1,827,938 | 10/1931 | Ericson | 123/51 A |
| 2,393,793 | 1/1946 | Meth | 123/90.57 |
| 2,539,877 | 1/1951 | Voorhies | 123/90.59 |
| 2,938,508 | 5/1960 | Papenguth | 123/90.59 |
| 2,962,012 | 11/1960 | Howson | 123/90.59 |
| 3,070,080 | 12/1962 | Slooten | 123/90.59 |
| 4,285,310 | 8/1981 | Takizawa et al. | 123/90.55 |

FOREIGN PATENT DOCUMENTS

| | | | |
|---|---|---|---|
| 65234 | 12/1946 | Denmark | 123/90.57 |
| 1400254 | 7/1975 | United Kingdom | 123/90.46 |

*Primary Examiner*—Ira S. Lazarus
*Assistant Examiner*—R. S. Bailey
*Attorney, Agent, or Firm*—Martin A. Farber

[57] ABSTRACT

A valve lash adjuster for a horizontally opposed engine in which valves are horizontally disposed and the adjuster for each valve is also horizontally disposed. The adjuster has a cylindrical body and a hollow plunger. The tip end of the plunger engages with a rocker arm of a valve lifting device of the engine. The plunger has a ball check valve for trapping oil in a pressure chamber defined behind the plunger and is outwardly biased by a spring for taking up clearance in the valve train. Passages are provided for supplying the lubricating oil into an annular groove provided around the cylindrical body. The passages are located at such positions that the oil remains in the groove. The inside chamber of the plunger is communicated with the annular groove through a hole located to communicate with the annular groove at the oil remaining zone, so that the oil is maintained in the inside chamber of the plunger and the pressure chamber.

8 Claims, 3 Drawing Figures

VALVE LASH ADJUSTER FOR AN INTERNAL COMBUSTION ENGINE

BACKGROUND OF THE INVENTION

The present invention relates to a hydraulic valve lash adjuster for taking up clearance in a valve train in an internal combustion engine, and more particularly to a lash adjuster in a valve lifting mechanism for an overhead-camshaft engine.

In a valve lifting device of an overhead-camshaft (OHC) engine, a hydraulic valve lash adjuster is used for taking up the clearance in the valve train. One type of such hydraulic adjusters comprises a cylindrical body secured in a wall of an engine case, a hollow plunger slidably engaged in the cylindrical body, passages for supplying lubricating oil in the hollow plunger passing through holes formed in the cylindrical body, a pressure chamber disposed behind the plunger, a ball check valve provided in the pressure chamber to close a valve port in the rear wall of the plunger to maintain pressure oil therein, and a spring disposed in the pressure chamber to urge the plunger outwardly. The tip end of the plunger engages with one end of a rocker arm, a cam engages with the rocker arm at an intermediate position of the arm, and the other end of the rocker arm engages with the top end of the valve stem.

If such a hydraulic adjuster is employed in the horizontally opposed cylinder type engine, the adjuster must be horizontally disposed in the wall of the engine case. However, the hydraulic adjuster does not effect the lifting of the valve in the horizontal disposition because of leakage of oil during an unoperated condition of the engine. More particularly, the lubricating oil in the plunger drains through a clearance between the plunger and the cylindrical body and in place of oil air enters the plunger, when the engine is stopped. In addition, if the engine is stopped at an open condition of the valve, where the plunger is forced into the cylindrical body and the pressure chamber contracts to the smallest capacity, the oil in the pressure chamber discharges through the clearance between the plunger and the cylindrical body. Therefore, when the engine is started under such a condition, the plunger is projected by the plunger spring disposed in the pressure chamber. As a result, the pressure chamber expands to induce the air in the plunger therein. Accordingly, the plunger cannot be held to a predetermined position due to the inducted air, so that the clearance in the valve train is not taken up. This means that the valve is not lifted to a predetermined position and the cam strikes the rocker arm, causing noise.

SUMMARY OF THE INVENTION

The object of the present invention is to provide a hydraulic valve lash adjuster in which oil is maintained in a plunger during the unoperated condition of an engine whereby clearances in the valve train may be taken up for ensuring operation of the valve.

According to the present invention, there is provided a hydraulic valve lash adjuster for horizontally opposed engine having horizontally disposed valves, and valve lifting devices, which comprise a cylindrical body securely mounted in an engine case; an annular groove in the engine case around the cylindrical body; passages communicating with a lubricating oil system of the engine and provided to open to the annular groove at higher positions so as to maintain oil in a lower portion of the groove; a hole formed in the cylindrical body at a portion lower than the position of the passages for communicating the annular groove with the inside of the body; a hollow plunger slidably engaged in the cylindrical body and having an outer tip end and a bottom; holes formed in the plunger for communicating the inside chamber thereof with the hole of the cylindrical body; a check valve provided in the bottom of the plunger for checking the flowing of oil into the inside chamber of the plunger; a pressure chamber defined by the bottom of the plunger and the bottom of the cylindrical body; a spring provided in the pressure chamber for outwardly biasing the plunger; and the tip end of the plunger being engaged with the valve lifting devices.

The present invention will be more apparent from the following description made with reference to the accompanying drawings.

DETAILED DESCRIPTION OF THE PREFERRED EMBODIMENTS

Figure 1:
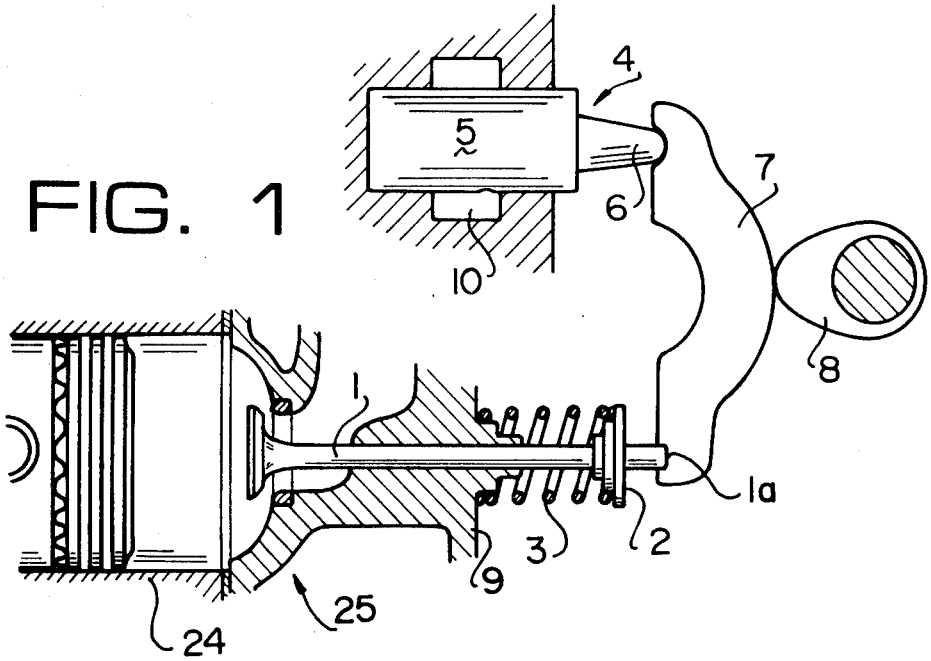
FIG. 1 is a sectional view showing one of several valve lifting mechanisms using a hydraulic valve lash adjuster according to the present invention.
Figure 2:
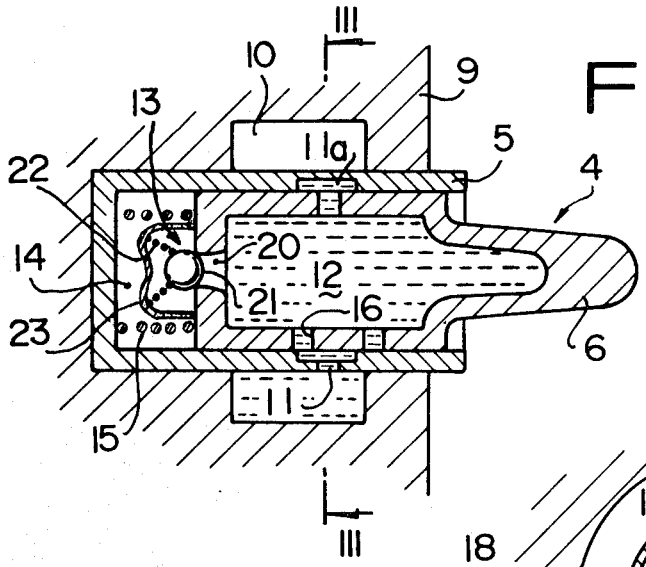
FIG. 2 is a sectional view showing an embodiment of the present invention.
Figure 3:
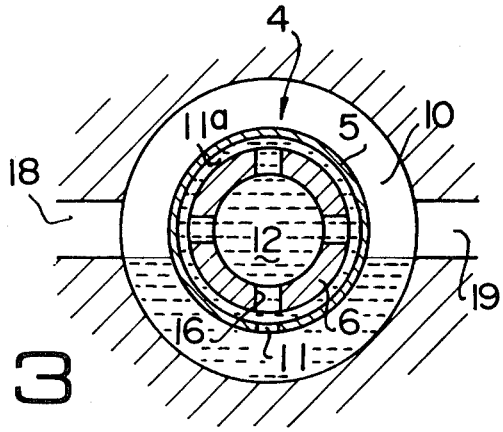
FIG. 3 is a sectional view taken along the line III—III of FIG. 2.

Referring to FIG. 1 showing a valve lifting mechanism provided for one of cylinders 24 of a horizontally opposed cylinder type engine 25, a valve 1 for the cylinder is biased by a valve spring 3 provided between a spring retainer 2 and a side wall of a case 9. A hydraulic valve lash adjuster 4 is provided in the case 9 in parallel with the valve 1. As shown in FIGS. 2 and 3, the hydraulic adjuster 4 comprises a cylindrical body 5 embedded in the case 9 and a hollow plunger 6 slidably mounted in the cylindrical body 5. One end of a rocker arm 7 is engaged with a stem end 1*a* of the valve 1 and the other end is engaged with the tip end of the plunger 6 and a cam 8 engages the rocker arm 7 at an intermediate portion thereof.

An annular oil groove 10 is provided in the case 9 around the body 5, and communicates with the lubricating oil system (not shown) of the engine through passages 18 and 19 so as to be supplied with the lubricating oil under pressure. As shown in FIG. 3, the passages 18 and 19 are horizontally disposed in the case 9 and communicate with the groove 10 at diametrically opposite positions. A hole 11 is formed in the body 5 at a lower portion thereof for communicating an inside annular groove 11*a* of the cylindrical body 5 with the groove 10. The plunger 6 is formed with holes 16 and an oil chamber 12 therein, the holes 16 communicating with the oil chamber 12 in the plunger 6 with the annular groove 11*a*.

The plunger 6 is provided with a ball check valve 13 at the inner end (called the bottom of the plunger) for communicating the oil chamber 12 with a pressure chamber 14 defined by the bottom of the plunger 6 and the corresponding end of the body 5 and the cylindrical wall of the body 5. The ball check valve 13 comprises a valve port 20 formed in the bottom of the plunger 6, a ball 21, a spring 22 supported by a retainer 23 which biases the ball 21 toward the valve port 20 to close it. Further, a spring 15 is provided between the bottoms of the plunger 6 and the body 5 so that bias the plunger outwardly to the end of the plunger engages the rocker arm 7.

In operation, oil under pressure from the lubricating oil system enters into the oil chamber 12 passing through the hole 11, the groove 11*a* and the holes 16. The oil further enters the pressure chamber 14 past the ball check valve 13 and is trapped therein. Rotation of the cam 8 causes the rocker arm 7 to rock so as to push the valve 1 to the left to open the valve. Since the clearance in the valve train is taken up by the oil in the hydraulic adjuster 4, the valve opens silently. When the valve closes, the plunger 6 projects outwardly by means of the spring 15. Thus, clearance in the valve train is taken up, and oil fills up the pressure chamber 14 through the check valve 13.

When the engine operation is stopped, the oil in passages 18 and 19 returns to the oil pan (not shown) and the passages communicate with atmosphere. However, since the passages are opened to the groove 10 at a higher position as shown in FIG. 3, oil is maintained in a lower portion of the groove 10. Thus, the hole 11 in the lower portion of the body 5 is prevented from communicating with the atmosphere by the oil in the groove 10. Therefore the oil is maintained in the oil chamber 12 and the pressure chamber 14, so that no air is induced into the pressure chamber. Thus, taking up of the valve lash in the valve train can be ensured.

From the foregoing, it will be understood that the present invention provides a hydraulic valve lash adjuster for a horizontally opposed engine which takes up clearance in the valve train and prevents a leakage of oil in the adjuster during the non-operating condition of the engine so as to ensure the valve lash adjustment.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A hydraulic valve lash adjuster for an engine having an engine case, a lubricating oil system of the engine, valves, and valve lifting devices each having at least one member engaging one of said valves and a cam engaging said member, comprising:

a substantially horizontally cylindrical body fixedly mounted in said engine case such that said cylindrical body has an open end and a bottom closes an inner end of said cylindrical body;

said engine case defining an annular groove around said cylindrical body, said annular groove having a substantially horizontally oriented axis;

passages formed in said case communicating said lubricating oil system of said engine with said annular groove through openings into said annular groove, said openings being substantially horizontally aligned and located at substantially diametrically opposite positions with respect to said annular groove, whereby oil is maintained below said openings in a lower portion of said annular groove;

said cylindrical body having a first hole formed at a portion in said cylindrical body lower than said openings communicating said lower portion of said annular groove with an inside surface of the cylindrical body, so that the first hole is in the oil maintained in the lower portion of the annular groove;

a hollow plunger slidably mounted in said cylindrical body and having a cylindrical portion, an outer tip end and a bottom and defining an inside chamber;

said bottom of said plunger and the bottom of said cylindrical body and the inside surface of said cylindrical body define therein a pressure chamber;

said plunger having second holes in said cylindrical portion communicating the inside chamber thereof with said first hole of said cylindrical body;

means comprising a check valve in said bottom of said plunger for permitting the oil to flow out of said inside chamber of the plunger into said pressure chamber and respectively for checking flow of the oil from said pressure chamber into the inside chamber of the plunger;

means comprising a spring disposed in said pressure chamber between said bottoms for outwardly biasing said plunger; and said tip end of said plunger being engaged with said member.

2. The hydraulic valve lash adjuster according to claim 1, wherein said cylindrical body is formed with an annular groove at the inside surface of said cylindrical body, said annular groove has an axial length longer than that the cross-section of said first hole, said annular groove in said cylindrical body communicates with said first hole and with said second holes respectively.

3. The hydraulic valve lash adjuster according to claim 2, wherein said second holes are spaced apart longitudinally with respect to said cylindrical body by a distance greater than said axial length of said annular groove in said cylindrical body.

4. The hydraulic valve lash adjuster according to claim 3, further comprising a plurality of third holes in said cylindrical portion communicates said inside chamber of the plunger with said annular groove in said cylindrical body.

5. The hydraulic valve lash adjuster according to claim 4, wherein said plurality of third holes are aligned substantially in a vertical plane between said second holes.

6. The hydraulic valve lash adjuster according to claim 1, wherein said at least one member is a rocker arm at ends thereof engaging said outer tip end of said plunger and said one of said valves and at an intermediate portion engaging said cam.

7. The hydraulic valve lash adjuster according to claim 6, wherein said engine is a horizontally opposed engine and said valves are horizontally disposed.

8. The hydraulic valve lash adjuster according to claim 1 wherein said first hole of said cylindrical body is located in the lowermost portion of said cylindrical body.

* * * * *